US009488949B2

(12) United States Patent
Fujita et al.

(10) Patent No.: US 9,488,949 B2
(45) Date of Patent: Nov. 8, 2016

(54) IMAGE FORMING APPARATUS

(71) Applicant: FUJI XEROX CO., LTD., Tokyo (JP)

(72) Inventors: Mamoru Fujita, Kanagawa (JP); Satoshi Tatsuura, Kanagawa (JP); Wataru Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/850,435

(22) Filed: Sep. 10, 2015

(65) Prior Publication Data

US 2016/0238971 A1 Aug. 18, 2016

(30) Foreign Application Priority Data

Feb. 12, 2015 (JP) ..... 2015-025220

(51) Int. Cl.
*G03G 15/00* (2006.01)

(52) U.S. Cl.
CPC ..... *G03G 15/6582* (2013.01); *G03G 15/6517* (2013.01); *G03G 15/6588* (2013.01); *G03G 2215/00455* (2013.01); *G03G 2215/00801* (2013.01)

(58) Field of Classification Search
CPC ..... G03G 15/65; G03G 15/6517; G03G 15/652; G03G 15/6529; G03G 15/6582; G03G 15/6885; G03G 15/6588; G03G 2215/00455; G03G 2215/00801
USPC ..... 399/390
See application file for complete search history.

(56) References Cited

U.S. PATENT DOCUMENTS

2007/0064026 A1* 3/2007 Hirakawa ..... B41J 29/38 347/6
2009/0233068 A1* 9/2009 Irita ..... C09D 11/40 428/211.1
2010/0079562 A1* 4/2010 Katada ..... B41J 2/175 347/85

FOREIGN PATENT DOCUMENTS

JP H10-55089 A 2/1998
JP 2007-121808 A 5/2007
JP 2010-072388 A 4/2010

* cited by examiner

*Primary Examiner* — Benjamin Schmitt
(74) *Attorney, Agent, or Firm* — Oliff PLC

(57) ABSTRACT

An image forming apparatus, includes an image forming section that forms an image layer on a recording medium by supplying and fixing a toner based on image information, a winding section that winds the recording medium on which the image layer is formed by the image forming section, an extraction section that extracts step portion which is formed at end portion of the image layer based on the image information, and an adjustment layer forming section that forms an adjustment layer which suppresses the step portion that is extracted by the extraction section on the recording medium.

9 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2015-025220 filed Feb. 12, 2015.

BACKGROUND (i) Technical Field

The present invention relates to an image forming apparatus.

(ii) Related Art

In an image forming apparatus, an image which is developed by a toner is transferred on a recording medium. For example, in a continuous image forming apparatus, a long recording medium is applied, and there is some cases in which a recording medium on which an image is formed is sequentially wound and contained in a layer shape on a circumferential surface of a winding roller.

SUMMARY

According to an aspect of the invention, there is provided an image forming apparatus, including:

an image forming section that forms an image layer on a recording medium by supplying and fixing a toner based on image information;

a winding section that winds the recording medium on which the image layer is formed by the image forming section;

an extraction section that extracts step portion which is formed at end portion of the image layer based on the image information; and an adjustment layer forming section that forms an adjustment layer which suppresses the step portion that is extracted by the extraction section on the recording medium.

BRIEF DESCRIPTION OF THE DRAWINGS

Exemplary embodiments of the present invention will be described in detail based on the following figures, wherein.

DETAILED DESCRIPTION

Figure 1:
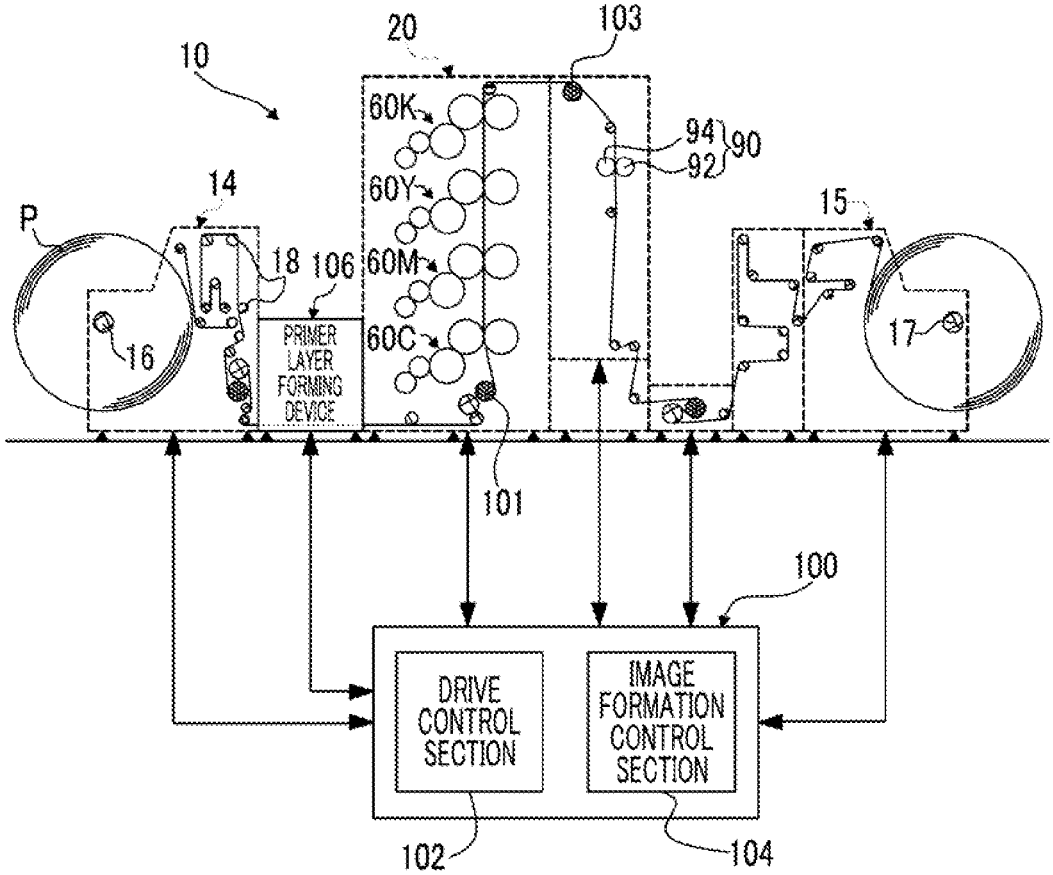
FIG. 1 is a schematic diagram of an image forming apparatus according to the present exemplary embodiment.

FIG. 1 schematically illustrates an image forming apparatus 10 according to the present exemplary embodiment.

A recording medium P is loaded in advance by being wound in a layered form around a feed roller 16 of a feed section 14. In the present exemplary embodiment, a corona treated OPP film (with a thickness of 20 μm) is applied as the recording medium P.

The recording medium P which is wound around the feed roller 16 is pulled out from the outermost layer of the feed roller 16, is wound around plural winding rollers 18, is transferred to an image forming section 20 (an example of an image forming unit) via a primer layer forming device 106 (an example of an adjustment layer forming unit), and is configured such that the recording medium P on which an image is formed by the image forming section 20 is wound around a winding roller 17 of a storage section 15. The winding roller 17 rotates so as to wind the recording medium P into a layered form.

Some of the winding rollers 18 are set to be drive rollers, and the recording medium P between the rollers is wound around the winding roller 17 while adjusting the tension of the recording medium P.

The image forming apparatus 10 is provided with a main controller 100. The main controller 100 is provided with a drive control section 102 and an image formation control section 104. The drive control section 102 controls the driving of a drive system (mainly motors) which transports the recording medium P in the feed section 14, the image forming section 20, and the storage section 15, and the image formation control section 104 acquires image data from outside, converts the image data into exposure data, and controls the image forming process in the image forming section 20.

Figure 3:
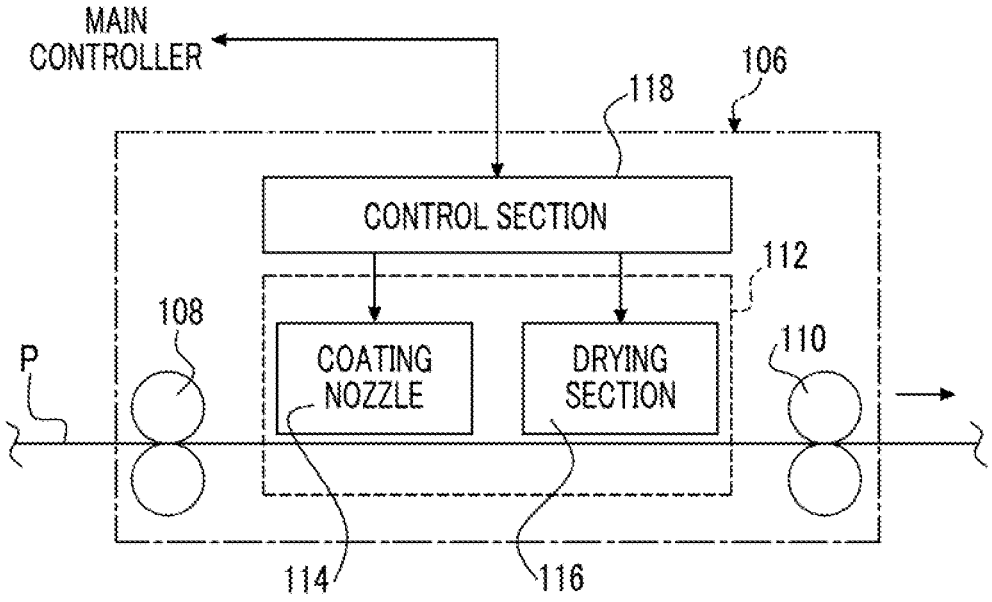
FIG. 3 is a schematic diagram of a primer layer forming device according to the present exemplary embodiment.

FIG. 3 schematically illustrates the primer layer forming device 106 according to the present exemplary embodiment.

As illustrated in FIG. 3, the primer layer forming device 106 of the present exemplary embodiment has a role of forming a primer on the recording medium P by applying a so-called ink jet printer function. Specifically, a printer layer (an adjustment layer) is formed on the recording medium P by coating a liquid agent (a fluid body including a liquid or a gel form, hereinafter referred to as "the primer") which may become the adjustment layer.

The recording medium P which is pulled out from the feed roller 16 (refer to FIG. 1) of the feed section 14 is guided to the primer layer forming device 106.

The primer layer forming device 106 is provided with roller pairs 108 and 110, respectively in the proximity of a receiving port and an output port of the recording medium P. The roller pairs 108 and 110 are driven by motors (not shown). The recording medium P is transported from the receiving port to the output port in a substantially horizontal manner, in a state of being interposed by each of the roller pairs 108 and 110.

A head section 112 is disposed between the roller pairs 108 and 110. The head section 112 is provided with a coating nozzle 114 and a drying section 116.

The primer layer forming device 106 is provided with a control section 118, including a processor, which is connected to the main controller 100.

The primer which is the liquid agent of the adjustment layer includes a function of improving the adherence between the recording medium P and the toner, and is applied to the whole region of the image formation surface of the recording medium P to form a primer layer (a basic function).

An olefin resin, a polyester resin, and a urethane resin may be applied as the primer.

Specific examples of the olefin resin include SUPERCHLON (manufactured by Nippon Paper Industries Co., Ltd.) and UNISTOLE (manufactured by Mitsui Chemicals, Inc.).

Specific examples of the polyester resin include VYLON (manufactured by Toyobo Co., Ltd.).

Specific examples of the urethane resin include SUPERFLEX (manufactured by DKS Co. Ltd., (registered trademark)) and BONTIGHTER (manufactured by Adeka Corporation).

Here, in the primer layer forming device 106 of the present exemplary embodiment, separately from the basic function (the toner adherence improvement function), the layer thickness of the primer layer is controlled based on the image data.

In other words, in the control section 118, the coating region, the time of coating, the coating amount (the coating thickness) of the primer are controlled by acquiring the image data from the main controller 100 and analyzing the image data, the coating being carried out by the coating nozzle 114. The control section 118 controls the air volume and the temperature of a drying air in the drying section 116 for drying the applied primer.

In the analysis of the image data, for example, the control section 118 enables the changing of the layer thickness of the primer in the band-shaped image region and the region other than the band-shaped image in the width direction when the image continues in a band shape in a portion of the width direction (a direction intersecting the transport direction) of the recording medium P along the transport direction. The band-shaped image is not necessarily limited to an image which continues without gaps, and may also foe a collection of images leaving a fixed or non-fixed gap therebetween (intermittent images). Note that, detailed description of the primer coating control will be given later.

Figure 2:
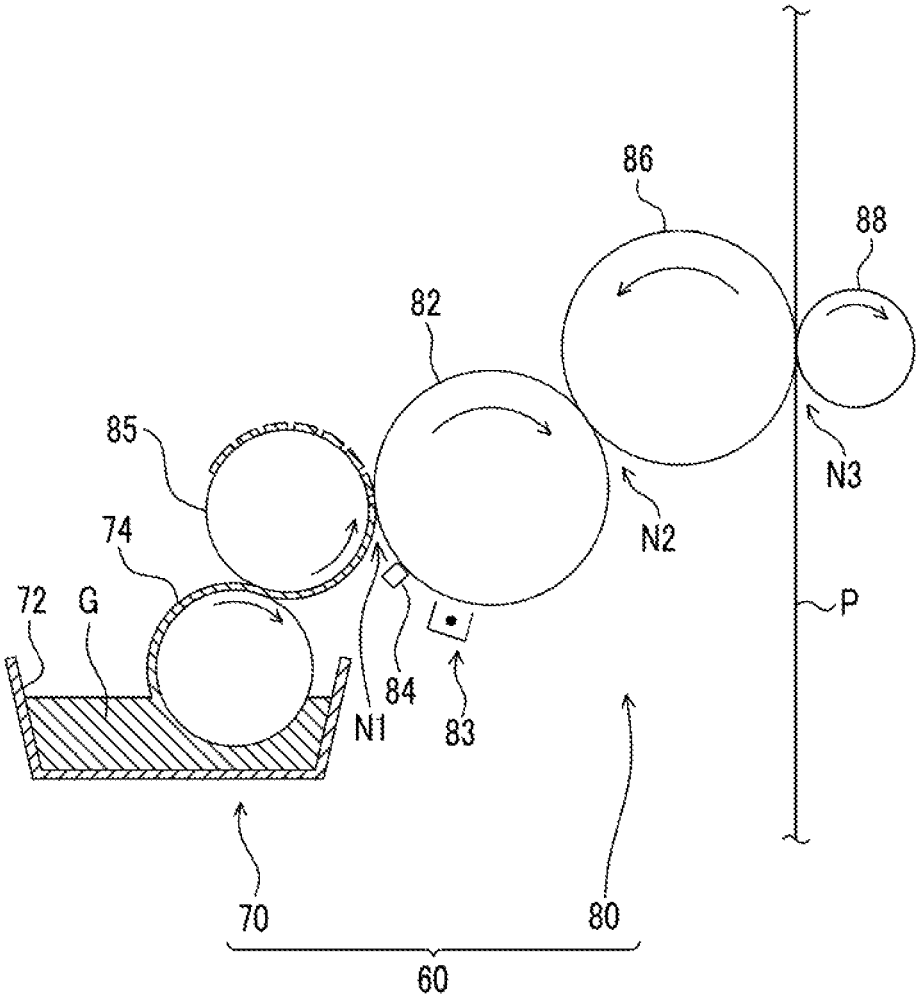
FIG. 2 is a schematic diagram of an image forming unit according to the present exemplary embodiment.

As illustrated in FIGS. 1 and 2, the image forming apparatus 10 is configured to transfer and fix a toner image formed of a toner G (refer to FIG. 2) to the surface of the recording medium P, and to form an image on the surface of the recording medium P.

The image forming section 20 includes a function of forming the toner image using the toner G, transferring the toner image to the surface of the recording medium P, fixing the toner to the surface of the recording medium P, and forming an image on the surface of the recording medium P. In the image forming section 20, image forming units 60C, 60M, 60Y, and 60K are disposed in the vertical direction (the apparatus height direction) of FIG. 1, and drive rollers 101 and 103 are respectively provided on the upstream side and the downstream side of the image forming units 60C, 60M, 60Y, and 60K.

The rotation speed of each of the drive rollers 101 and 103 is controlled independently by the drive control section 102 of the main controller 100. For example, the transport speed of the drive roller 103 of the downstream side is set faster than the transport speed of the drive roller 101 of the upstream side so as to maintain the tensile force (the tension) of the recording medium P being transported within a predetermined range.

The image forming units 60C, 60M, 60Y, and 60K each include a function of forming a toner image of the respective color and transferring the toner image of the respective color to the recording medium P which is transported. The image forming units 60C, 60M, 60Y, and 60K are disposed from the upstream side to the downstream side (from the bottom to the top in FIG. 1) in the transport direction of the recording medium P along the transport path of the recording medium P in the denoted order.

Here, the letter "C" means cyan, "M" means magenta, "Y" means yellow, and "K" means black, and the image forming units 60C, 60M, 60Y, and 60K are configured to form toner images of a C color, a M color, a Y color, and a black color, respectively. The image forming units 60C, 60M, 60Y, and 60K have the same configuration as each other except for the toner color of the toner contained in the toner G which is used.

Therefore, although the details of one of the image forming units 60 is described using FIG. 2, description is given omitting the characters C, M, Y, and K.

As illustrated in FIG. 2, the image forming unit 60 includes a toner supply section 70 and a transfer section 80.

The toner supply section 70 contains the toner G and includes a function of supplying the toner G to the transfer section 80. The toner supply section 70 is provided with a container 72 and a supply roll 74. Note that, a portion of the supply roll 74 is immersed in the toner G which is contained in the container 72.

The container 72 is connected to an external tank (not shown), and is configured to be replenished with the toner G which is stored in the external tank.

The supply roll 74 picks up the toner G which is stored in the container 72 while rotating, and supplies the toner G to a developing roll 85 (described later). Here, the toner G is configured such that the layer thickness is adjusted by a blade (not shown), and is, for example, positively charged and supplied to the developing roll 85.

The transfer section 80 transfers the toner image which is formed on a photoreceptor 82 (described later) using the toner G onto the recording medium P. The transfer section 80 is provided with the photoreceptor 82, a charging device 83, an exposure device 84, the developing roll 85, a transfer drum 86, and a transfer roll 88.

The photoreceptor 82 includes a function of holding a latent image, and the charging device 83 includes a function of charging the photoreceptor 82.

The exposure device 84 includes a function of forming a latent image on the photoreceptor 82 which is charged by the charging device 83, and the developing roll 85 includes a function of developing the latent image which is held by the photoreceptor 82 as the toner image using the toner G which is supplied from, the toner supply section 70.

The developing roll 85 forms a nip N1 with the photoreceptor 82. A voltage is applied to the developing roll 85 while the developing roll 85 rotates, and the latent image which is held by the photoreceptor 82 is developed as the toner image using the electric field which is formed at the nip N1.

The transfer drum 86 has a function of causing the toner image which is formed on the photoreceptor 82 to primary transfer to the outer circumferential surface of the transfer drum 86 and holding the toner image. The transfer drum 86 forms a nip N2 with the photoreceptor 82. A voltage is applied to the transfer drum 86 while the transfer drum 86 rotates, and the toner image on the photoreceptor 82 is primary transferred to the outer circumferential surface of the transfer drum 86 using the electric field which is formed at the nip N2.

The transfer roll 88 has a function of causing the toner image which is held on the outer circumferential surface of the transfer drum 86 to secondary transfer to the recording medium P which is transported. The transfer roll 88 is disposed on the opposite side from the transfer drum 86 to interpose the transport path of the recording medium P, and forms a nip N3 with the transfer drum 86. A voltage is applied to the transfer roll 88 while the transfer roll 88 rotates, and the toner image which is held on the outer circumferential surface of the transfer drum 86 is secondary transferred to the recording medium P using the electric field which is formed at the nip N3.

As illustrated in FIG. 1, a fixing device 90 is provided on the downstream side (closer to the downstream side than the drive roller 103) of the image forming unit 60. The fixing device 90 is provided with a heating roll 92 and a pressure roll 94.

The fixing device 90 includes a function of fixing the toner image which is formed by the image forming unit 60 to the surface of the recording medium P by heating and pressing a multicolored toner image which is formed on the surface of the recording medium P by the image forming unit 60.

Printer Coating Control

Here, in the present exemplary embodiment, the recording medium P on which an image is formed by the image forming section 20, as described earlier, is wound and stored by the winding roller 17 of the storage section 15.

The premise of the winding to the winding roller 17 is that the recording medium P has a uniform medium thickness. In other words, since the medium thickness is fixed in the state in which an image is not formed on the recording medium P, the winding diameter does not change over the entire region, theoretically.

However, when the image is formed by the image forming section 20, the toner is transferred to the recording medium P as the image. The toner is not uniformly transferred to the entire region of the recording medium P, and the toner amount which is transferred varies according to the image data (the exposure data).

In particular, when a continuous or intermittent image (hereinafter referred to as "the band image") which extends in the transport direction (the direction in which the recording medium P is wound) is present in a region which is limited to a specific width Wt (Wt<W), a step is generated in the width direction of the recording medium P between the band image region and the image region other than the band image region, the step corresponding to the toner thickness.

The step amount (the step dimension) increases in proportion to the winding amount by which the recording medium P is wound onto the winding roller 17 in a layered form, and when a specific winding amount is exceeded, non-uniform expanding and shrinking forces arise in the recording medium P, and "wrinkles" are formed (winding faults).

In the present exemplary embodiment, in the primer layer forming device 106, in the coating of the primer to the recording medium P, in addition to the basic function described earlier, in order to cancel out the thickness (the layer thickness) of the toner, the primer coating amount (coating thickness) is changed according to the image data.

Figure 4:
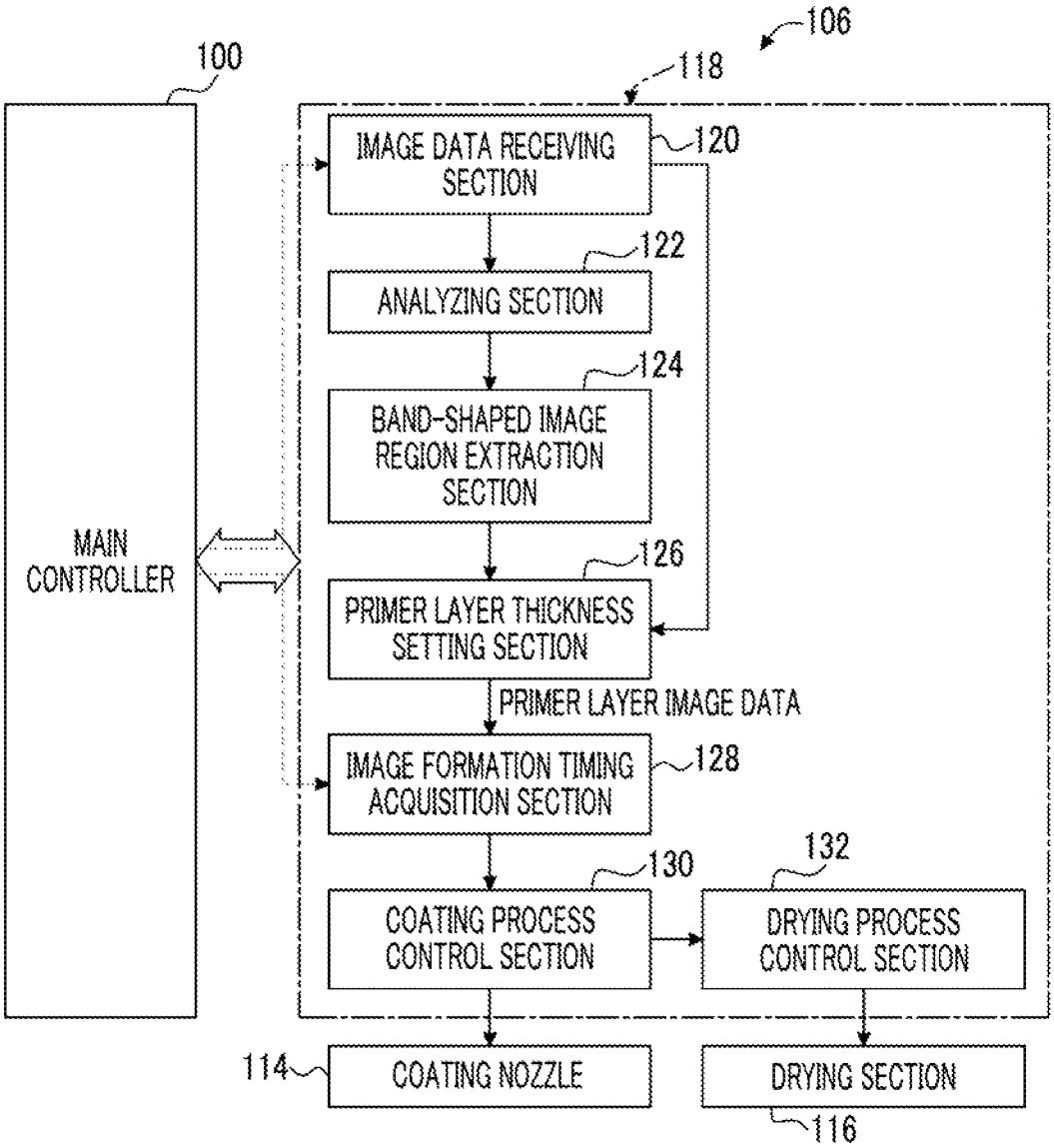
FIG. 4 is a functional block diagram for primer layer forming control carried out by a control section of the primer layer forming device according to the present exemplary embodiment.

FIG. 4 is a functional block diagram for primer coating control in the control section 118 of the primer layer forming device 106. Note that, FIG. 4 does not limit the hardware configuration of the control section 118.

The control section 118 is provided with an image data receiving section 120, and receives the image data from the main controller 100.

The image data receiving section 120 is connected to an analyzing section 122, and the image data which is received by the image data receiving section 120 is transmitted to the analyzing section 122. In the analyzing section 122, the image data is analyzed.

In the analyzing section 122, for example, the occupation distribution of the image region is analyzed for each color of CMYK, and the analysis results are transmitted to a band-shaped image region extraction section 124.

In the band-shaped image region extraction section 124, a band-shaped image region is extracted from the analysis results (the occupation distribution of the image region for each color) of the analyzing section 122.

The band-shaped image region, for example, is a region in which a continuous or intermittent image is present in a band shape in a portion of the width direction (a direction intersecting the transport direction) of the recording medium P for each color along the transport direction.

The band-shaped image region extraction section 124 is connected to a primer layer thickness setting section 126. The image data which is received by the image data receiving section 120 is input to the primer layer thickness setting section 126. In the primer layer thickness setting section 126, the layer thickness of the primer layer is determined for each pixel depending on the resolution of the image data based on the extracted band-shaped image region. In other words, image data is generated according to the primer layer (hereinafter referred to as "the primer layer image data").

Here, the band-shaped image has modes such as a case in which the band-shaped image is present in a portion of the width direction of the recording medium P, a case in which plural band-shaped images are present at an interval (a striped image), a case in which the interval of the band-shaped images in the striped image is greater than or equal to a predetermined threshold, and a case in which the same interval is less than the threshold.

In the primer layer thickness setting section 126, in addition to the minimum necessary layer thickness for improving the toner adherence, the band-shaped image region which causes the step during the winding and the other image regions are distinguished on a per-color basis, and the primer layer thickness is set.

Example of Setting of Primer Layer Thickness

Figure 5A:
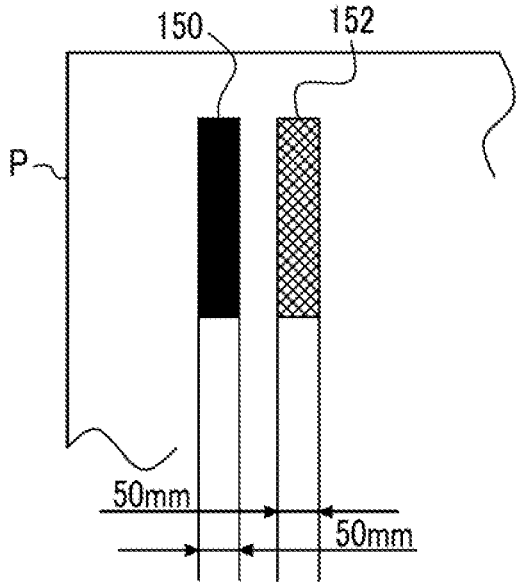
FIG. 5A is a plan diagram of a recording medium onto which a band-shaped image region is formed.
Figure 5B:
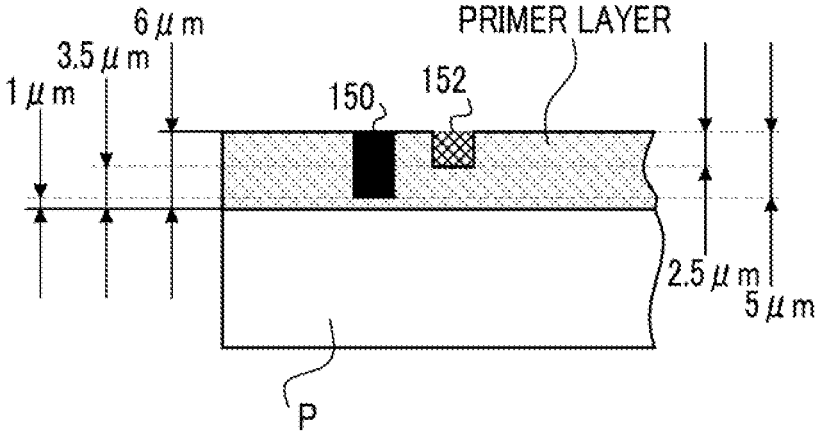
FIG. 5B is a section diagram of the side surface of FIG. 5A.

FIGS. 5A and 5B are an example of setting the primer layer thickness in a case in which the image is formed leaving a predetermined interval (for example, an interval of 50 mm) in the width direction between a 50 mm wide black band image region 150 and a 50 mm wide cyan band image region 152 on the recording medium P.

As illustrated in FIG. 5B, the toner thickness of the black band image region 150 is 5 μm, and the toner thickness of the cyan band image region 152 is 2.5 μm.

When the layer thickness of the primer for improving the toner adherence is 1 μm, the maximum layer thickness on the recording medium P is 6 μm at the black band image region 150.

For example, in a case in which it is predicted that winding faults (for example "wrinkles") will occur when the recording medium P is wound and the cumulative value of the step reaches 50 μm, when the recording medium P is wound 10 revolutions (step of the black band image region of 5 μm×10 revolutions=50 μm), there is a likelihood of winding faults occurring. Note that, the transport distance at this time is indicated by the winding diameter×circular constant (π)×the wind count, and is 20 m when the winding diameter is approximately 31.8 cm.

Therefore, in the cyan band image region 152, the layer thickness of the primer is set as 3.5 μm, the layer thickness of the primer of a region other than the black band image region 150 and the cyan band image region 152 (a non-image region) is set as 6 μm, and the primer is applied. As a result, as illustrated in FIG. 5B, the total layer thickness on the recording medium P becomes theoretically fixed. The term "theoretically fixed" means a "fixed" scope within a range of predetermined tolerance.

Note that, each of the numerical values of FIGS. 5A and 5B is an example, and each layer thickness is not limited to the numerical values.

As illustrated in FIG. 4, the primer layer thickness setting section 126 is connected to an image formation timing acquisition section 128. In the image formation timing acquisition section 128, when the primer layer image data is input from the primer layer thickness setting section 126, the image formation timing is read from the main controller 100, and the primer thickness image data is transmitted to a coating process control section 130 based on the image formation timing.

The coating process control section 130 controls the coating nozzle 114 to execute the coating of the primer layer. The coating process control section 130 is connected to a drying process control section 132, and instructs the drying process control section 132 to carry out the drying by the drying section 116 synchronously with the primer coating process in the coating process control section 130.

Hereinafter, description will be given of the operations of the present exemplary embodiment.

Flow of Image Formation

First, description will be given of the flow of the processes for the image formation in the image forming apparatus 10.

In the main controller 100, when the image data is received, the image data is converted into exposure data of each color, and the exposure data of each color is transferred to the exposure device 84 which configures the image forming unit 60.

Next, based on the image formation execution, instructions, in the image forming unit 60C, due to a photoreceptor 82C being charged by a charging device 83C and the charged photoreceptor 82C being exposed by an exposure device 84C, a latent image for the C color is formed on the photoreceptor 82C. The latent image for the C color is developed as the toner image of the C color by a developing machine 85C which is supplied with the toner G of the C color from a toner supply section 70C.

Next, the toner image of the C color reaches the nip N2 due to the rotation of the photoreceptor 82C, and is primary transferred to a transfer drum 86C. The toner image of the C color which is transferred to the transfer drum 86C reaches the nip N3 due to the rotation of the transfer drum 86C. The toner image of the C color which reaches the nip N3 is secondary transferred by a transfer roll 88C to the surface of the recording medium P which is transported.

In the same manner, in the image forming units 60M, 60Y, and 60K which configure the image forming unit 60, the toner images of the M color, the Y color, and the K color are sequentially secondary transferred onto the surface of the recording medium P from transfer drums 86M, 86Y, and 86K so as to overlap the toner image of the C color which is secondary transferred onto the surface of the recording medium P.

Next, the recording medium P, on the surface of which the toner images of each color are formed by the image forming unit 60, reaches the fixing device 90. The toner images of each color on the surface of the recording medium P are fixed to the surface of the recording medium P by being heated and pressurized by the fixing device 90.

Primer Coating Control

In the present exemplary embodiment, in addition to the basic function in the primer layer forming device 106, in order to cancel out the thickness of the toner, the primer coating amount (coating thickness) is changed according to the image data.

In other words, as a basic function, when applying the primer to the whole region of the recording medium P, the layer thickness of the primer is adjusted based on the image data ox the recording medium P in order to reduce the step caused by the difference in the layer thickness of the toner.

Figure 6:
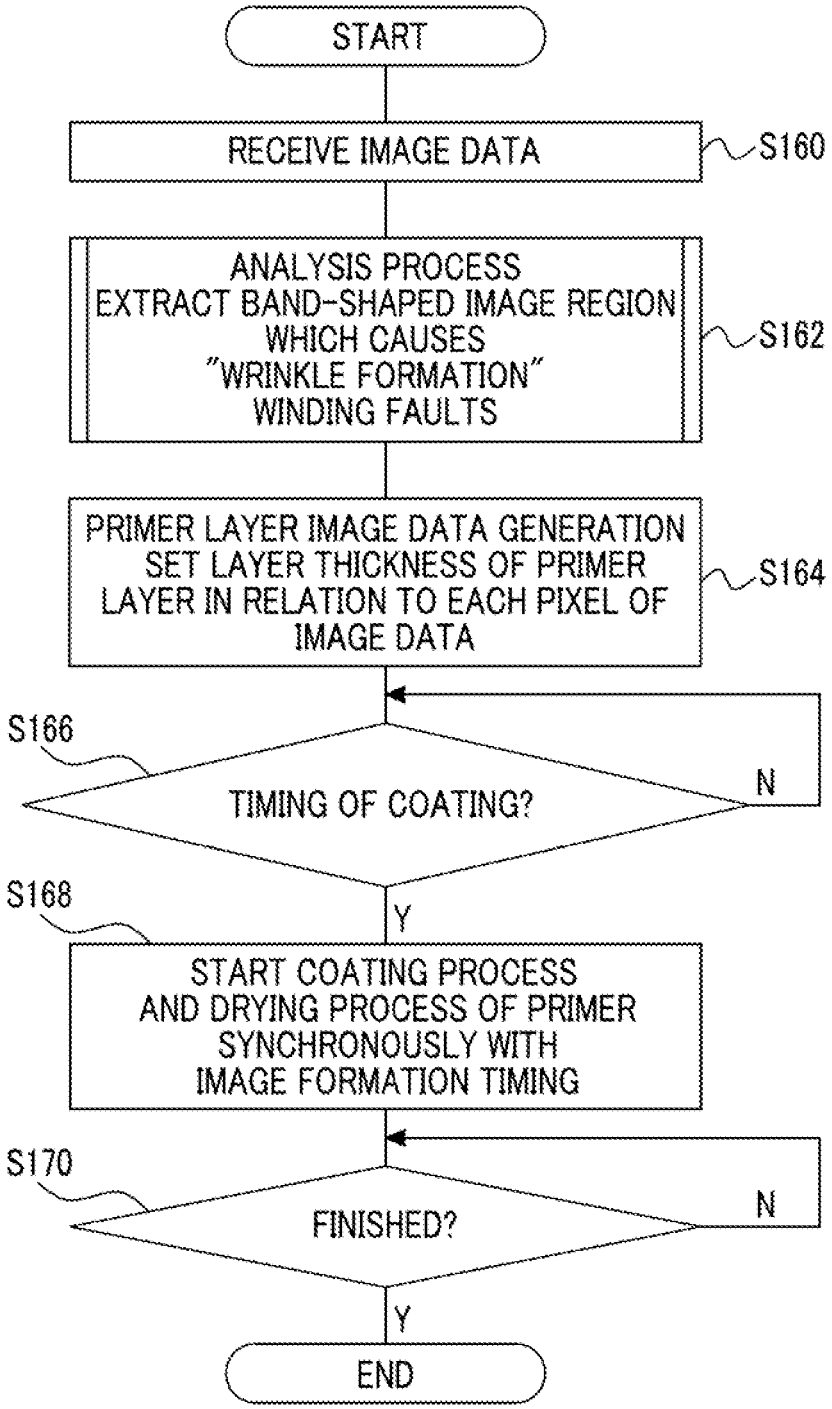
FIG. 6 is a flowchart illustrating a primer layer forming control routine carried out by the control section of the primer layer forming device according to the present exemplary embodiment.

FIG. 6 is a flowchart illustrating the flow of primer coating control in the control section 118 of the primer layer forming device 106.

In step 160, the image data is received from the main controller 100, the process subsequently transitions to step 162, and the analysis process of the received image data is executed.

In other words, band-shaped regions, which cause the winding faults which occur (the "wrinkles" which are formed) during the winding onto the winding roller 17, are extracted.

In the next step 164, the primer layer image data is generated. In other words, the layer thickness of the primer layer is set in relation to each pixel of the image data.

Here, "the primer layer image data" is the data in which the layer thickness of the primer layer is set in relation to each pixel of the image data. In the "primer layer image data", if the resolution is the same in the image forming section 20 and the primer layer forming device 106, the resolution (the number of pixels) at which to apply the primer layer corresponds 1:1 with the resolution (the number of pixels) of the image data.

In the next step 166, it is determined whether or not it is time to apply the primer based on the image formation timing information which is acquired from the main controller 100.

When the determination in step 166 is positive, the process transitions to step 168 and starts the coating process followed by the drying process of the primer synchronously with the image formation timing information.

As a result, the recording medium P, to which the primer layer with a differing layer thickness according to the image data is applied, is transported to the image forming section 20 (refer to FIG. 1). In this case, on the recording medium P, the primer layer (a bottom layer) is distinguished as a primer layer of a uniform thickness as the basic function, and the primer layer (a top layer) of a non-uniform thickness which depends on the image data (the toner image).

In the next step 170, when it is determined whether or not the coating of the primer is finished and the determination is positive, the routine is finished.

According to the present exemplary embodiment, for example, as illustrated in FIGS. 5A and 5B, when the 50 mm wide black band image region 150 and the 50 mm wide cyan band image region 152 are image formed on the recording medium P leaving an interval in the width direction (the toner thickness of the black band image region 150 is 5 μm, and the toner thickness of the cyan band image region is 2.5 μm), when the primer is uniformly (1 μm) applied, the formation of "wrinkles" is observed at a point in time at which 200 m of the recording medium P is wound onto the winding roller 17 (winding faults present). Note that, the wind count at this time is 100 revolutions, and the winding diameter is approximately 31.8 cm.

In contrast, when the primer is applied with the layer thickness of the primer on the black band image region 150 set as 1 μm, the layer thickness of the primer on the cyan band image region 152 set as 3.5 μm, and the layer thickness of the primer on the other regions (the non-image region) set as 6 μm, the formation of "wrinkles" is not observed (no winding faults) even if 200 m of the recording medium P is wound onto the winding roller 17.

In other words, since the step of the layer thickness on the recording medium P is reduced by the primer layer, the winding faults such as the formation of "wrinkles" are reduced regardless of the winding amount to the winding roller 17.

Note that, in the present exemplary embodiment, due to the band-shaped image region continuing in the transport direction, since the "wrinkles" become remarkable and the winding faults occur, a configuration is adopted in which the band-shaped image regions which cause the winding faults are extracted and the layer thickness of the primer layer is adjusted; however, the image regions in which the step increases according to the winding amount to the winding roller 17 are not limited to band-shaped image regions. For example, it is valid to adopt layer thickness adjustment which uses the primer layer in relation to an image disposition in which images which are interspersed on a plane overlap each other in the radial direction in a state in which the recording medium P is wound onto the winding roller 17.

In the present exemplary embodiment, a primer layer for reducing the step is formed at the same time as the coating of the primer layer for improving the toner adherence before the image formation; however, on the downstream side of the image forming section 20, a raising layer for reducing the step may be formed, limited to regions in which the toner is not transferred.

Furthermore, although it is preferable for the resolution during the primer layer coating based on the image data in the primer layer forming device 106 to be the same as the resolution during the image formation in the image forming section 20, the resolutions may not necessarily match.

In the present exemplary embodiment, although an ink jet system image forming unit is applied as the primer layer forming device 106, the invention is net limited to the ink jet system as long as the device is capable of selectively applying the primer onto the recording medium P according to the information of extracted step portions.

For example, for an exemplary embodiment which may be used instead of the ink jet system, the primer may be applied uniformly to the recording medium P using a die coater, and may be applied to necessary portions (regions in which the step portions are to be reduced) using a syringe such as a dispenser.

In the present exemplary embodiment, although a corona treated OPP film in which the effect of reducing the wrinkles is remarkable is applied as the recording medium P, the recording medium P is not limited to the corona treated OPP film, and may be ordinary paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming section that forms an image layer on a recording medium by supplying and fixing a toner based on image information;

a winding section that winds the recording medium on which the image layer is formed by the image forming section;

a processor that acts as:

an extraction section that extracts a step portion which is formed at an end portion of the image layer based on the image information; and an adjustment layer forming section that forms an adjustment layer which suppresses the step portion that is extracted by the extraction section on the recording medium, wherein the adjustment layer forming section forms the adjustment layer to have a minimum layer thickness for toner adherence, and a variable primer layer thickness of a band-shaped image region that causes the step during the winding with other image regions distinguished on a per-color basis.

2. The image forming apparatus according to claim 1, wherein, among the step portions that occur along a direction intersecting a transport direction of the recording medium, the extraction section extracts the step portion that is continuous or intermittent in the transport direction at a predetermined length, and that is greater than or equal to a predetermined threshold value.

3. The image forming apparatus according to claim 1, wherein the adjustment layer is a liquid agent that increases an adhesive force between the toner and the recording medium, and wherein the adjustment layer forming section forms an adjustment layer on the recording medium positioned at an upstream of the image forming section before image formation.

4. The image forming apparatus according to claim 3, wherein the adjustment layer is formed over substantially an entire surface of the recording medium.

5. The image forming apparatus according to claim 3, wherein the adjustment layer forms a bottom layer having a uniform layer thickness and a top layer having an adjusted layer thickness.

6. The image forming apparatus according to claim 3, wherein the adjustment layer changes a layer thickness according to image data.

7. The image forming apparatus according to claim 3, wherein the liquid agent contains a resin which is at least selected from a group of an olefin resin, a polyester resin, and an urethane resin.

8. The image forming apparatus according to claim 1, wherein the adjustment layer forming section includes a coating section and a drying section.

9. The image forming apparatus according to claim 1, wherein the recording medium is a film.

* * * * *